US006189264B1

(12) United States Patent
DiVeroli

(10) Patent No.: US 6,189,264 B1
(45) Date of Patent: Feb. 20, 2001

(54) HURRICANE STORM PANEL AND METHOD OF INSTALLATION

(76) Inventor: Oscar DiVeroli, 9108 NW., 105 Way, Medley, FL (US) 33178

( * ) Notice: Under 35 U.S.C. 154(b), the term of this patent shall be extended for 0 days.

(21) Appl. No.: 09/364,027

(22) Filed: Jul. 30, 1999

(51) Int. Cl.[7] ..... E06B 9/00

(52) U.S. Cl. ..... 49/57; 49/62; 49/463; 52/202; 160/215

(58) Field of Search ..... 160/215, 135, 160/91, 196.1, 184; 52/202; 49/61, 463, 464, 57, 62

(56) References Cited

U.S. PATENT DOCUMENTS 2,170,110 * 8/1939 Booth ..... 49/62
3,745,704 * 7/1973 Covington .
4,685,261 * 8/1987 Seaquist .
5,345,716 * 9/1994 Caplan .
5,347,775 * 9/1994 Santos ..... 52/202
5,487,244 * 1/1996 Hill .
5,540,018 * 7/1996 Biggers ..... 52/202
5,579,615 * 12/1996 Hoffman .
5,651,221 * 7/1997 Golen .
5,740,639 * 4/1998 Covington .
5,855,099 * 1/1999 Hoffman ..... 52/202
5,996,292 * 12/1999 Hill et al. ..... 52/202

* cited by examiner

*Primary Examiner*—Blair M. Johnson
(74) *Attorney, Agent, or Firm*—Malin, Haley & DiMaggio, P.A.

(57) ABSTRACT

The invention encompasses a storm shutter system. The system utilizes a track above an opening, a shutter that is held by the track that covers the opening, a retainer that in conjunction with the track acts to hold the shutter in place, a means for retaining the shutter once the shutter has been installed. The shutter system can be deployed from the inside and is therefore very useful in protecting windows above the ground floor. The storm shutter system is useable with various types of windows including stacked windows and horizontal sliding windows.

19 Claims, 6 Drawing Sheets

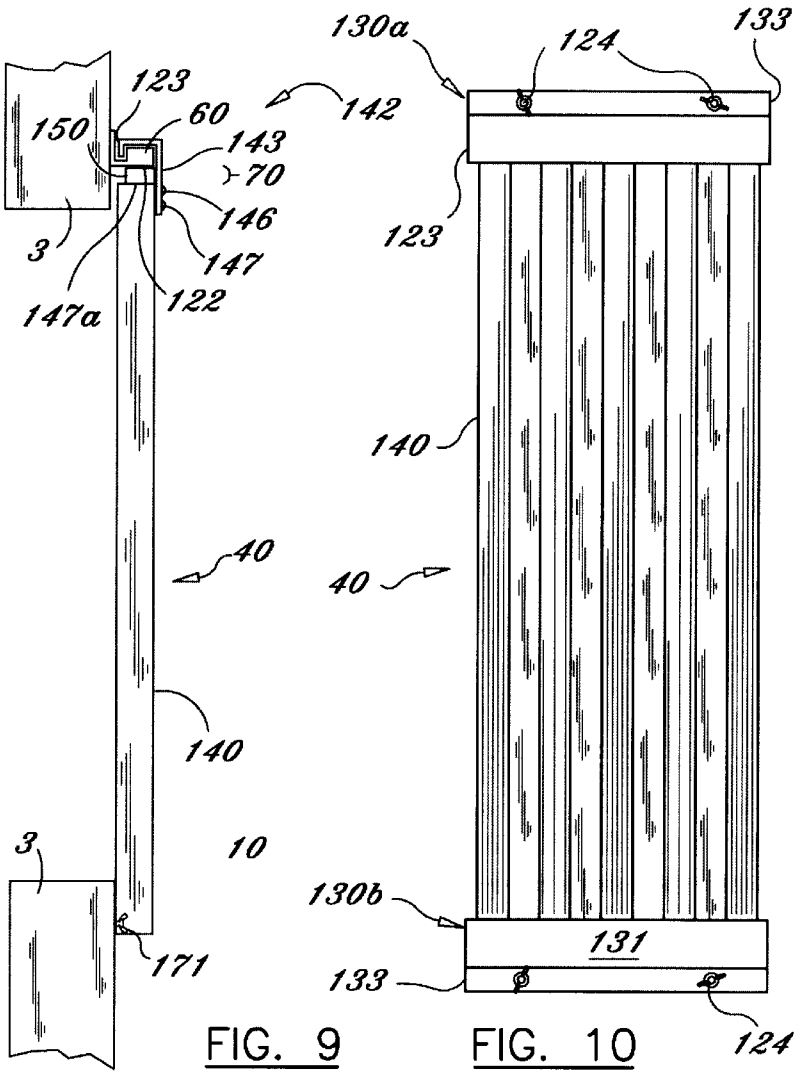
FIG. 10
FIG. 9
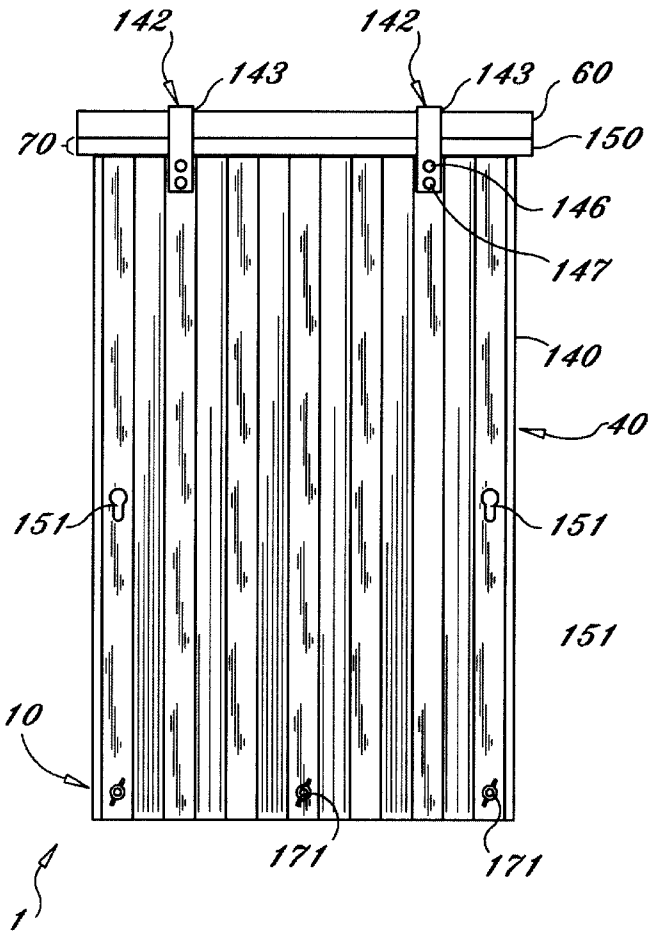
FIG. 8

HURRICANE STORM PANEL AND METHOD OF INSTALLATION

BACKGROUND OF THE INVENTION

1. Field of the Invention

The present invention relates to improved storm shutters that cover and protect windows and other openings even in hurricane-strength winds. This invention not only allows installation from the exterior of a house, the invention also allows installation from the interior of a building. By installing from the interior, the storm shutters of the invention can protect windows and openings above the ground floor with a minimum of risk to the installer.

2. Description of the Prior Art

In Broward County, Florida, the County Board of Rules and Appeals recently implemented a change in the code governing shuttering of all windows above the ground floor on all structures, except single family detached homes. The Code prohibits the use of storm panels above first story windows due to safety to life issues. Specifically, the concern is for individuals climbing ladders to install storm panels during pre-hurricane strength winds and rain. Existing alternatives to storm panels include accordion shutters, roll-up shutters, or impact glass windows.

An alternative to attachable shutter is roll up shutters. Roll-up shutters cost eight times as much as storm panels. Additionally, existing homes may require the area around the windows to be redesigned to accommodate the accordion or roll-up shutters.

Impact-resistant glass (also known as impact glass) is made by reinforcing glass with layers of transparent polymer. The polymer reinforces the glass and prevents shattering even if the glass becomes broken. Impact glass windows cost about eight times as much as storm panel systems. Furthermore, the polymeric layer of impact glass is soft and subject to scratching. Scratches in the polymer are visible and can weaken the impact glass. Scratch resistant impact glass turns yellow when exposed to ultra-violet rays. Impact glass comprising two-layers of glass sandwiching the polymer increases the cost beyond other impact glass.

Existing storm shutters must be installed from the outside. Existing storm shutters cannot be installed from the inside because the bolts that attach the shutter to the house are only reachable from the outside. So, once the window is covered the user can no longer reach around to insert the bolts.

These existing storm shutter systems typically use two tracks to hold shutters. The top track, also known as the h-track, in shaped like a lowercase "h" having the long edge mounted horizontally against the wall above the opening. The bottom track typically has an L-shaped cross-section and has its vertical portion mounted horizontally to the wall beneath the opening. This L-track has horizontal pegs protruding perpendicularly to the vertical leg. A shutter is inserted into the h-track and then bolted to the peg. The shutter must be attached from the outside to fasten the shutters via the bolts. These systems do not utilize panel hangers that hook onto the tracks.

The following U.S. Patents are examples of shutters that cannot be deployed from within the inside of the structure being protected: Caplan, U.S. Pat. No. 5,345,716; Taylor, U.S. Pat. No. 5,335,452; Seaquist, U.S. Pat. No. 4,685,261; Covington, U.S. Pat. No. 3745,704; Covington, U.S. Pat. No. 5,740,639; Golen, U.S. Pat. No. 5,651,221; Sanford U.S. Pat. No. 5,603,190; Hill, U.S. Pat. No. 5,596,849; Hoffman, U.S. Pat. No. 5,579,615; Hill, U.S. Pat. No. 5,487,244; and Dietz et al. U.S. Pat. No. 5,477,646.

U.S. Pat. No. 4,726,149 issued to Tryba for a "Fixture for Protection of Windows." The fixture is a plywood panel that can be seated from inside into a window frame where a screen is typically fitted. This device is limited to use with windows having extruded casings. In addition, the window frame itself is not protected by the shutter.

U.S. Pat. No. 3,745,704 issued to Covington for a "Storm Shutter Installation." In one embodiment, the invention can be installed inside a building. However, in this embodiment the shutter is placed inside of the glass. The shutter does not protect the glass but only mitigates the damage caused should the glass break.

The design of windows can worsen the problem of attaching shutters from the inside. Most windows are one of two types of design: single hung or horizontal sliding. A single hung window involves two panes of glass stacked vertically. A single hung window is opened by raising the bottom pane. Once open, a single pane window allows access across the entire width of the window. The second type of design is the horizontal sliding window. A horizontal sliding window has two panes stacked horizontally (side by side). To open a horizontal sliding window, the first pane is slid sideways to overlap the second pane. Once open, a horizontal sliding window only allows access to half the width of the window—the other half is blocked by the stacked panes.

SUMMARY OF THE INVENTION

The present invention is a storm panel system that can be installed from the inside containing a track, at least one panel braced on the track, and a means for blocking the panel from lifting from said panel.

The system includes a shutter that covers an opening of a structure. The shutter can comprise a single panel or a plurality of panels that interconnect.

The storm panel systems of the present invention includes a track along the top of the opening, a shutter that covers the opening, a retainer that braces the shutter so it is retained by the track and a means to prevent the panel from lifting from the track. The retainer can be any suitable device that braces the panel. Examples include but are not limited to a track and bolts threaded through the panel into the structure.

In one embodiment, the top of each panel includes one or more panel hangers that attach to a J-track. The J-track and the inverted h-track are rigidly attached to the structure, above and below respectively of the opening. The hook and J-track allow the panels to be easily hooked and slid along the J-track.

The storm panels are shaped to add strength. A preferred shaped is an isosceles trapezoid corrugation. The panels can be made of impact resistant material such an steel, aluminum, polycarbonate, and LEXAN®.

In one embodiment of the invention, an inverted h-track is located to the exterior of an opening. The inverted h-track is rigidly attached to the building structure. The inverted h-track is horizontal to the opening and in close proximity and below the bottom of the opening that is desired to be covered. Above the window in close proximity thereto is a J-track. The J-track is also parallel to the opening and rigidly attached to the structure.

The openings to be covered typically include either a single hung window or a sliding window arrangement with one end window pane fixed in place.

Installation for a horizontal sliding window poses challenges that are not present in a single-hung window. In a horizontal sliding window, when the window is open, half the width of the window in blocked by the overlapping window panes. This blocking prevents the installer from being able to reach around to the exterior of panels that cover the overlapping panel.

This invention provides a shutter system and method of use that uses two tracks to hold panels without reaching around to the front of the panels for horizontal sliding windows. To install the panels, first, the horizontal sliding window is opened. Then, while the installer stands inside the structure at close proximity to the window opening. A corrugated panel is moved through the window opening to the exterior of the structure. The bottom of the corrugated panel is first placed in the inverted h-track and the top is tilted outward, away from the structure. The corrugated panel has a plurality of panel hangers on its top. A panel hanger is an upside down J-shaped member that engages and hangs from the J-track. Said panel hanger acts like a hook on the J-track. The J-track acts like a rail such that the hook slides on the rail. The arrangement can be reversed such that the panel hanger is the rail and the track is the hook.

To engage the J-track, the panel is lifted slightly to allow the j-shaped member's lip to pass over the J-track lip. To make the lifting possible, the panel must extend higher above the top of the panel. The distance from the top of the shutter to the bottom of the lip of J-shaped member must be greater than the height of the J-track lip and shorter than the lip of the h-track. Once the bottom of the corrugated panel is inserted into the inverted h-track and raised a sufficient distance above the base of the h-track, the panel is brought closer to the top J-track so that the panel hanger can come over the outside lip of the J-track and hook onto said J-track. In raising the panel, the depth of the h-track is designed not to release the panel bottom even when the panel is lifted to engage the panel hangers and J-track. At that point, the panel hangers are aligned on the J-track, the bottom of the corrugated panel is within the inside portion of the h-track, and the panel hanger rests on the outward portion of the J-track. A gap remains between the top of the panel and the bottom of the J-track. This gap is used to lift the panel and to remove the hanger from the track during removal. The corrugated panel is then moved in a sliding manner away from the open window portion towards the fixed window portion. A new panel is then placed into position as just described. Thereafter, the corrugated panel is moved over to engage and slightly overlap the first or prior corrugated panel. Once the first corrugated panel overlaps the second corrugated panel, continuing plurality of corrugated panel can be added and locked into position until the opening is completely covered. To prevent the panels from sliding off the end of the J-track, the J-track contains self tapping metal screws that will not allow the panel hangers to slide past. To prevent unintended removal of the panels caused by lifting, a block is attached to the bottom of the J-track at the end furthermost from the open side of the window. The block prevents the panels from lifting. The block runs only a partial length of the J-track. By running only a partial amount of the J-track, panels can be installed in the area not having a block. Furthermore, after the panels are stitched together with stitch bolts, the existence of a top bar at one end will retain shutters located along the entire length of the J-track. The last panel installed in this manner for each particular opening has a handle on the inside of the panel, so that said panel can be held by the person inside.

An alternative installation may be described for a single hung window. In this case, it is not necessary to use an inverted h-track along the entire base of the window. Because the installer is not blocked by the overlapping windows, the installer can reach around and fasten the panels at their bottom to the house by driving a bolt through the panel into the house. However, a partial h-track is necessary to hold the final panel because the final panel cannot be bolted from the inside. In addition, while the partial h-track must be in place during installation of the panels, when the panels are removed, the h-track can be removed. By minimizing the presence of the h-track, the negative aesthetic impact to the appearance of the house are minimized.

BRIEF DESCRIPTION OF THE DRAWINGS

FIG. 8 is a front view of a second embodiment utilizing a beam.

FIG. 9 is a left side view of the embodiment shown in FIG. 8.

FIG. 10 is a front view of a third embodiment of an embodiment including two h-tracks.

DETAILED DESCRIPTION OF THE PREFERRED EMBODIMENTS

Figure 1:
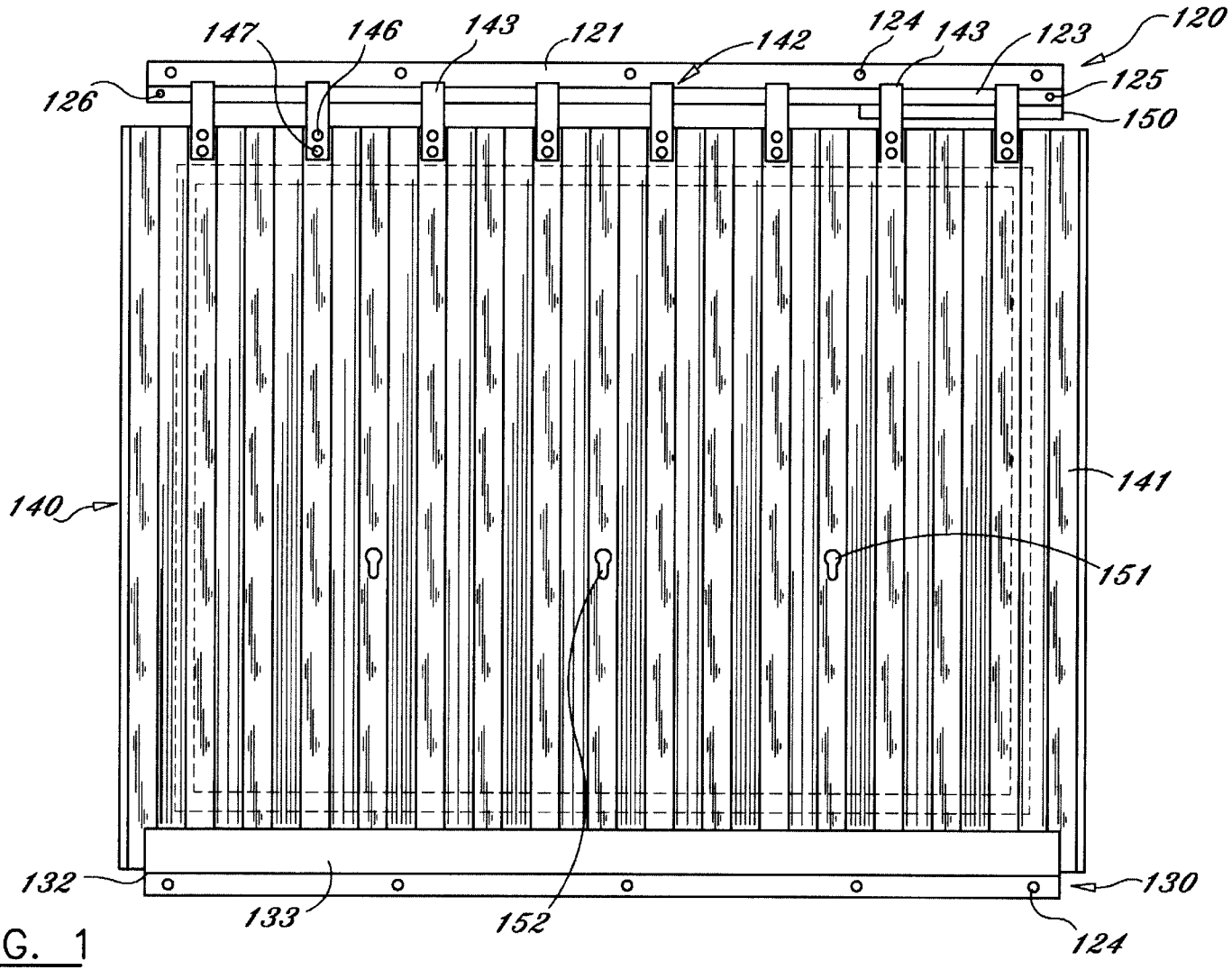
FIG. 1 is a front view of a horizontal sliding window having storm panels fully enclosing said window.
Figure 3:
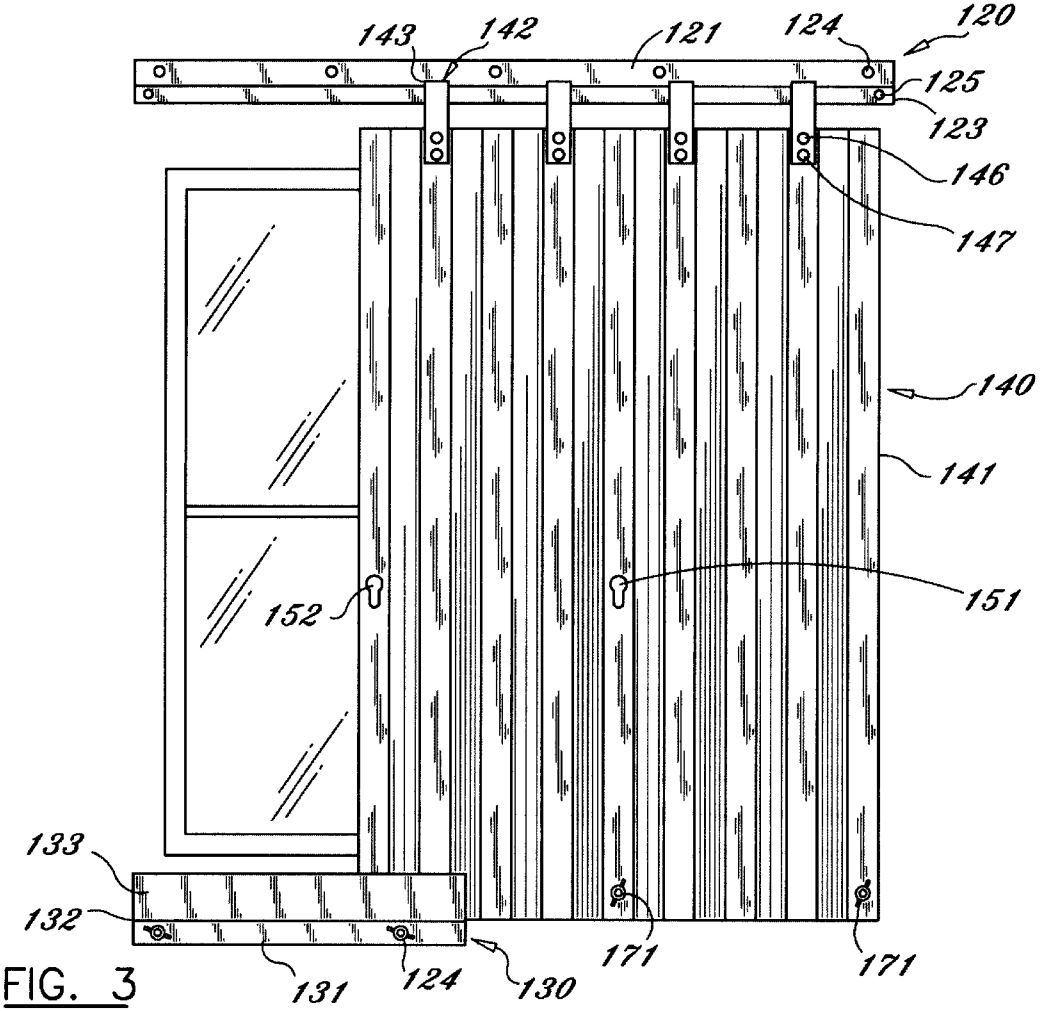
FIG. 3 is a front view of a partially enclosed, single hung window having the remainder of the storm panels shown in phantom.
Figure 2:
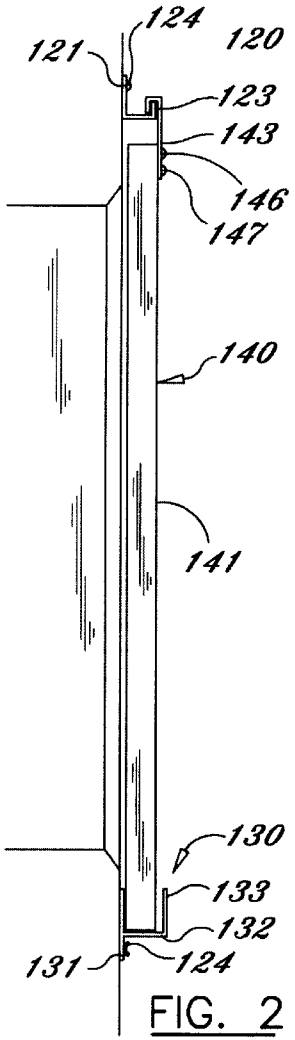
FIG. 2 in a right side view of window having storm panels installed.

The invention encompasses shutter system 1. Shutter system 1 is a removable system that protects opening 2 in structure 3. Shutter system 1 can be installed in existing structure 3. Typically, shutter system 1 is deployed to protect opening 2 during a storm such as a hurricane.

FIGS. 1–7 depict a first embodiment of the shutter system. In this embodiment, the shutter system 1 includes J-track 120. J-track 120 is an extruded track having a j-shaped cross section. J-track comprises three rectangular sheets; flange 121, abutment 122, and lip 123. Flange 121 connects at its bottom edge to the rear edge of abutment 122. The front edge of abutment 122 attaches to the bottom edge of lip 123. J-track 120 is fastened to structure 3 above opening 2. J-track 120 is mounted horizontally. J-track 120 is attached to the house by a plurality of fasteners 124. Typically, fasteners 124 are self-tapping screws or lagscrews that are inserted through flange 121 into the house.

In this embodiment, retainer 10 is h-track 130. h-track 130 has a cross-section similar to an inverted, lower-case "h". h-track 130 comprise three rectangular sheets: flange 131, horizontal sheet 132, and vertical sheet 133. Flange 131 is joined to the back edge of horizontal sheet 132; preferably, horizontal sheet 132 joins flange 131 two thirds from the top of long vertical sheet 131. The front edge of horizontal edge 132 joins with the bottom edge of short vertical sheet 133. h-track attaches horizontally below the window. J-track 120 and h-track are parallel to each other. Fasteners 124 are drilled through flange 131 into structure 3 to attach h-track 130 to structure 3.

Shutter 40 comprises a plurality of panels 140. Panels 140 are not as tall as the distance between abutment 122 and horizontal sheet 132 but taller than the distance between abutment 12 and horizontal sheet 132 less the height of lip 123.

Gap 70 is defined as the space between top 147 of shutter 40 when braced by retainer 10 (in this embodiment h-track 130) and abutment 122. Gap 70 is taller than lip 123. For this reason, shutter 40 can be lifted off or placed on h-track 130 and J-track 120. Block 150 can be inserted in gap 70 to prevent shutter 40 from being lifted off J-track 120. Block 150 is no taller than gap 70 but no shorter than the height of the gap minus the height of lip 123.

Panel 140 comprises corrugated steel sheet 141 having a plurality of panel hangers 142. Corrugated steel sheet 141 has an isosceles trapezoidal cross section. Panel hangers 142 are J-shaped and comprise long vertical member 143 attached at the top to horizontal member 144 that is attached at its rear edge to short vertical member 145. Short vertical member 145 is smaller than lip 123. Panel hanger 142 attaches to the outside top of corrugated steel sheet 141 by a nut and bolt 146 driven through long vertical member 143 and steel sheet 141. Pop rivet 147 is also punched through vertical member 143 and steel sheet 141 to reinforce the attachment and to prevent pivoting around nut and bolt 146.

Figure 5:
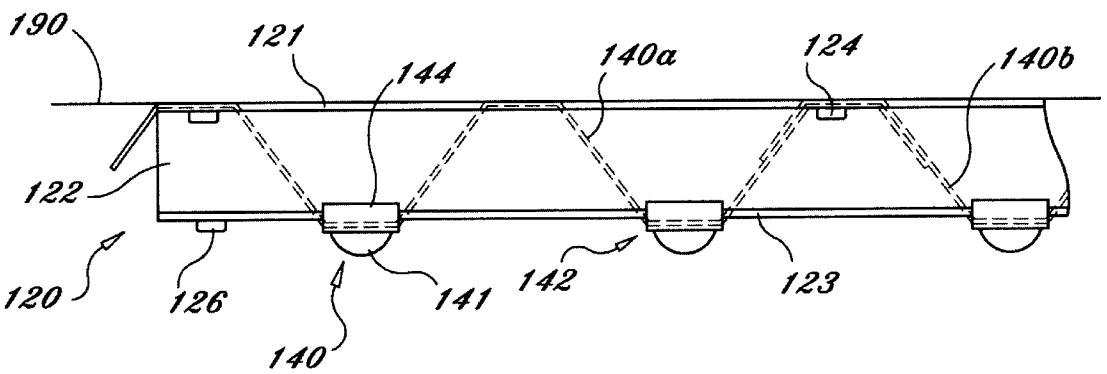
FIG. 5 is a top view of the left end of an installed panel system showing one complete panel engaged with a portion of a second panel.
Figure 4:
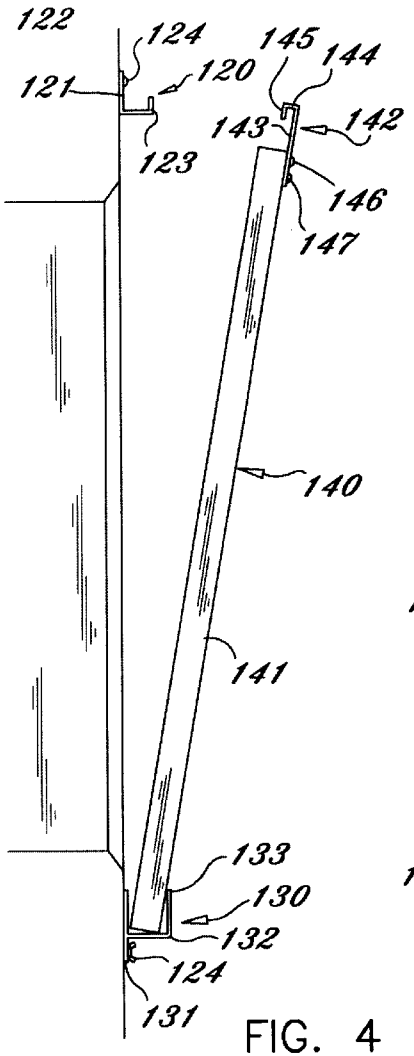
FIG. 4 is a right side view of a window showing a storm panel in its tilted position and the same storm panel is shown in its installed position in phantom.
Figure 7:
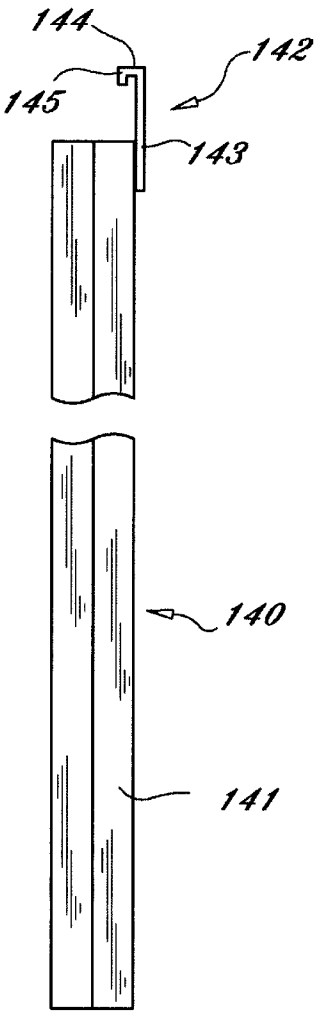
FIG. 7 is a right side view of a storm panel.
Figure 6:
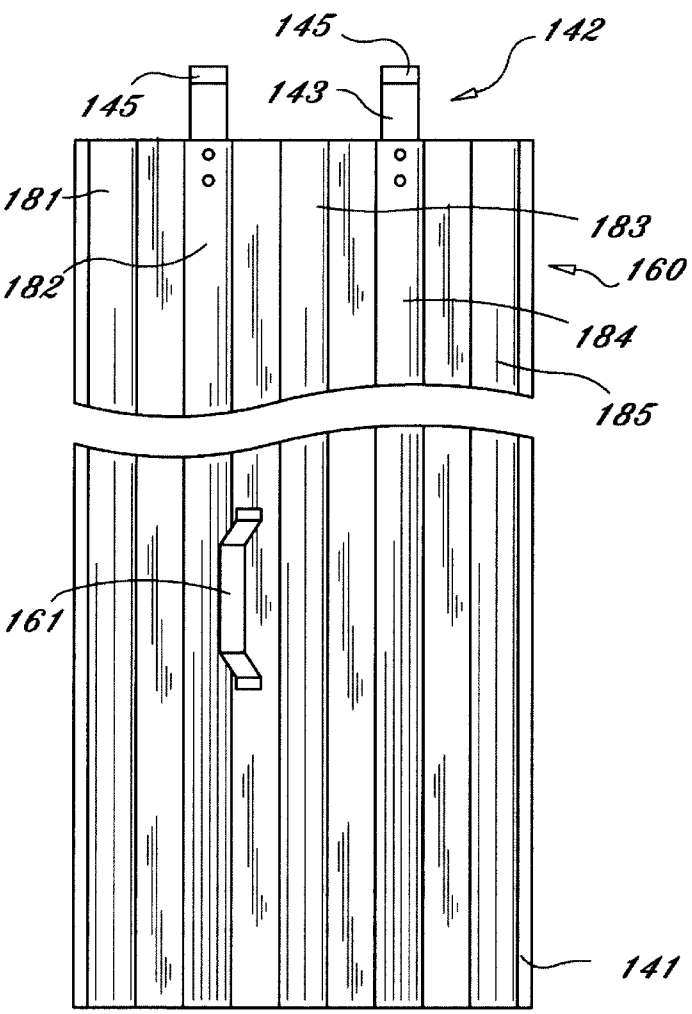
FIG. 6 is a rear view of the final panel.

FIG. 5 shows a top view of one complete panel 140*a* and a portion of a second panel 140*b*. Referring to panel 140*a*, sheet 141*a* preferably comprises five flat portions 181, 182, 183, 184, and 185. Three of said flat portions 181, 183, and 185 are mounted on the rear of panel 140*a* proximate structure 3. Flat portions 182 and 184 are mounted on the front of the panel and are spaced from structure 3. Panel hangers 142 of each panel 140 are mounted on each front flat portion 182 and 184. This configuration allows the two adjacent panels 140*a* and 140*b* to overlap and interlock. By attaching panel hangers 142 to the exterior of flat panels 182 and 184, panel hangers 142 do not interfere with the overlapping of one panel 140*a* on the adjacent panel 140*b* when panels 140*a* and 140*b* are overlapped. Further placement of the panel hangers 142 in the flat panel 182 and 184 positions allow placement of the panel close to the structure than an arrangement of panel holders 142 in the flat panel 181, 183, and 185.

Shutter 40 is deployed to protect structure 3 during a storm. To install shutter 40, the bottom of panel 140 is inserted in h-track 130 between short vertical sheet 133 and flange 131. Panel 141 is lifted enough to lift short vertical member 145 over lip 123 but no so much as to lift panel 140 above short vertical sheet 133.

Typically, more than one panel is used to cover a typical opening. By using more, narrower panels, the weight of each panel remains manageable. A plurality of panels 140 are added until the opening is covered. To add an additional panel 140*b* to an already installed panel 140*a*, additional panel 140*b* is inserted into j-track 130 and h-track 140 as before, but added panel 140*b* is added so as to overlap installed panel 140*a*. When overlapping, the corrugated shape of panels 140 complement each other. Preferably, each panel 140*a* and 140*b* have keyholes 151 and 152, respectively. Keyholes 151, and 152 are located so that keyholes 151 and 152 overlap when panels 140*a* and 140*b* are overlapped. Stitch bolt 153 can be inserted through keyholes 151 and 152 from the inside of structure 3. Stitch bolt 153 fastens adjacent panels 140*a* and 140*b*.

Panel 140 can be installed while standing in the house. Corrugated steel sheet 141 is held on its right and left sides or by handle 161 and is fed through the window. Handle 161 is attached to the inside of sheet 140.

The type of retainer that can be used is affected by the type of window that is to be protected. Horizontal sliding windows typically involve a window having two panes of glass that are horizontally adjacent to each other. When closed, the two panes slightly overlap each other in the middle of the window. To open the window, one of the panes is slid horizontally to overlap the other leaving the an opening where the first window was slid.

Shutter 40 can be installed in a horizontal sliding window according to the following method. Panels 140 are engaged with J-track 120 and h-track 130 and slid toward the closed side of the horizontal sliding window. Additional panels are added and slid toward the closed window. To prevent panels 140 from being slid too far where they might 15 fall off J-track 120, screws 125 and 126 are attached to each end of the outer face of lip 123. Long vertical member 143 abuts screw 125 as long vertical member 143 is sliding along J-shaped track 120.

To prevent unintended lifting of panel 140, block 150 is added in gap 70 under J-track 120. Block 150 is located at the end of J-track nearest the closed window. Block 150 is almost as thick as gap 70. Block 150 prevents J-track 120 and support member from disengaging each other by preventing corrugated steel sheet 141 from lifting. Each panel has a left keyhole 151 and right keyhole 152. Keyhole 151 and 152 are located at the same height and distance from their respective edges so that when panels 141 overlapped the right keyhole of the first panel 141 overlaps the left keyhole of the second panel. Removable bolt 153 is inserted through overlapping keyholes 151 and 152.

In the case of a horizontal sliding window, the final panel must be installed differently than the other panels because access to the exterior of final panel 140*c* becomes limited. Final panel 140*c* is the same as panel 140 but includes handle 161. Handle 161 is located on the back (interior) side of corrugated steel sheet 141. Handle 161 allows panel 140*c* to be held without gripping the edges. Stitch bolt 153 is inserted from the interior of final panel 140*c*.

In the case of single hung windows (also known as vertically sliding windows), the second preferred embodiment can be used. In the second preferred embodiment, h-track 130 is as wide as final panel 140*c* and is located underneath the window with its edge in line with the side edge of the window. A plurality of panels 140 are hung on J-track 120. The bottom of panels 140 are fastened to the house under the window by a retainer that comprise a plurality of bolts 171 that are screwed through panels 140 into structure 3. Final panel 140*c* is inserted into h-track 130 and J-track 120. Final panel 140*c* is retained by h-track 130 and not by bolt 171 because the exterior of final panel 160 cannot be accessed from the inside of structure 3 once final panel 140*c* is in place.

Another embodiment is shown in FIGS. 8–9. In this embodiment, beam 60 is attached above opening 2. In this embodiment, the bottom of beam 60 acts as abutment 122. Shutter 40 has hangers 142 that allow shutter 40 to hang from beam 60. For this embodiment, the short vertical member of hanger 142 acts as lip 123. Retainer 10 can be any suitable means that, in conjunction with beam 60 and block 150, hold shutter 40 on structure 3. Bolts 171 are threaded through shutter 40 and fastened with wingnuts. Block 150 is inserted between abutment 122 and top 147 of shutter 40. Block 150 is removed to allow deployment and removal of shutter 40.

Figure 12:
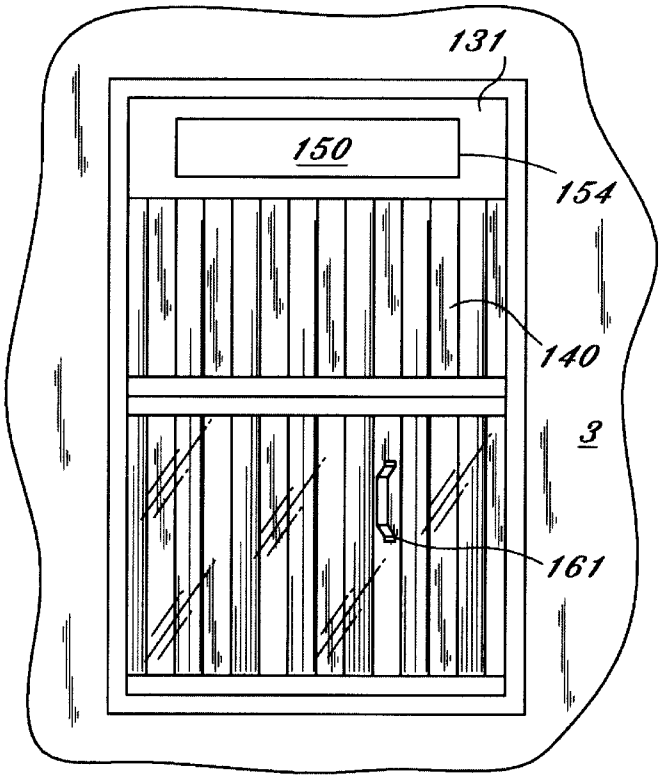
FIG. 12 is a rear view of the third embodiment shown in FIGS. 10 and 11 depicting the view of a deployed shutter system through a stacked window having both of its panes lowered.
Figure 11:
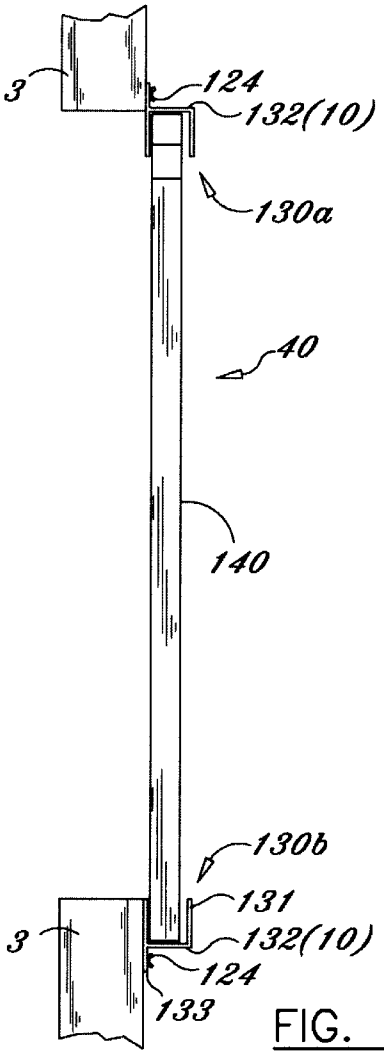
FIG. 11 is a side view of the embodiment shown in FIG. 10.

Another embodiment is shown in FIGS. 10–12. In this embodiment, a first and second h-track hold shutter 140 on structure 3. First h-track 130*a* is located above opening 2 and extends downward over opening 2. Second h-track 130*b* is below opening 2. First and second h-track are parallel to each other. The horizontal sheet of first-track 130*a* acts as abutment 122. The short vertical sheet of first h-track 130*a* acts as lip 123. As shown in FIG. 12, long vertical sheet 131 of first h-track 130*a,* contains opening 154. Block 150 can be inserted between top 147 and abutment 122. Block 150 prevents shutter 40 from lifting off h-tracks 130*a* and 130*b*.

What is claimed is:

1. A shutter system for protecting an opening in a structure that can be deployed from within said structure comprising;

a retaining means for attachment to said structure, an abutting means for attachment to said structure, said abutting means including a flange adapted to extend perpendicularly from said structure, a shutter having a top edge proximate said abutting means, wherein said shutter is moveable between and supported by said retaining means and said abutting means, and wherein said shutter is designed to cover said opening, a lip attached to said abutting means that holds said shutter to said structure, said lip including a vertical plate attached to an edge of said flange opposite said structure and extending away from said shutter, wherein said lip has a vertical dimension smaller than a gap that is defined between said top edge and said flange when said shutter is braced by said retaining means, and a means for securing said shutter to said lip.

2. A shutter system as described in claim 1, wherein said retaining means is an h-track.

3. A shutter system as described in claim 1, wherein said shutter contains a hole, and wherein said retaining means is a bolt for connection to said structure that threads through said hole.

4. A shutter system as described in claim 1, wherein said means for securing is a block that fills said gap and prevents said shutter from being removed, wherein said block is taller than the height of said gap less the height of said lip, and less than the height of said gap.

5. A shutter system as described in claim 4, wherein said block is removable.

6. A shutter system as described in claim 1, wherein said means for securing comprises a screw inserted through said shutter into said structure.

7. A shutter system as described in claim 1, wherein said shutter further comprises at least one hanger along said top that allows said shutter to hang from said abutting means.

8. A shutter system as described in claim 1, wherein said shutter further comprises at least one panel that has a top proximate said a means, and is braced by said retaining means.

9. A shutter system as described in claim 8, wherein said retaining means comprises:

an h-track that is as wide as a last-to-be-inserted panel, and a bolt for each remaining panel, wherein said bolt connects said panel to said structure.

10. A shutter system as described in claim 8, wherein said shutter comprises a plurality of panels, wherein each panel is attached to at least one adjacent panel.

11. A shutter system as described in claim 10, wherein each of said panels contain a keyhole that overlaps a keyhole of an adjacent shutter that allows a stitching bolt to connect said overlapping panels.

12. A shutter system as described in claim 1, wherein said shutter has a cross-section shaped like a series of isosceles trapezoidal corrugations.

13. A shutter system as described in claim 1, wherein said shutter system further comprises a handle attached to said shutter.

14. A shutter system as described in claim 1, wherein said shutter is constructed from the group of impact-resistant materials comprising steel, aluminum, and polycarbonate.

15. A shutter system as described in claim 1, wherein said abutting and said lip means are parts of an h-track.

16. A shutter system as described in claim 7, further comprising:

a rivet that connects said shutter to said hanger, a bolt that runs through said hanger and said shutter, and a nut that fits on said bolt to fasten said hanger to said shutter.

17. A shutter system for protecting an opening in a structure that can be deployed from within said structure comprising:

a h-track for attachment to said structure beneath said opening, a j-track having a lip attached to an abutment, said j-track for attachment to said structure above said opening, and wherein said h-track is parallel to said j-track, a shutter for covering said opening, wherein said shutter has a top proximate said abutment and at least one hanger on said top that hangs on said j-track, wherein said shutter is moveable between said j-track and said h-track because said lip is smaller than a gap that is defined between said top and said abutment when said shutter is braced by said h-track, and a block that fills said gap and prevents said shutter from being removed, wherein said block is taller than the height of said gap less the height of said lip, and less than the height of said gap.

18. A shutter system for protecting an opening in a structure that can be deployed from within said structure comprising:

a h-track for attachment to said structure beneath said opening, a beam having an abutment, said beam for attachment to said structure above said opening, and wherein said beam is parallel to said h-track, a shutter for covering said opening, wherein said shutter has a top proximate said abutment and at least one hanger on said top that hangs on said beam, wherein said hanger has a lip, wherein said shutter is moveable between said j-track and said h-track because said lip is smaller than a gap that is defined between said top and said abutment when said shutter is braced by said h-track, and a block that fills said gap and prevents said shutter from being removed, wherein said block is taller than the height of said gap less the height of said lip, and less than the height of said gap.

19. A shutter system for protecting an opening in a structure that can be deployed from within said structure comprising:

a first h-track for attachment to said structure beneath said opening, a second h-track having a lip attached to an abutment, wherein said second h-track is for attachment to said structure above said opening, and wherein said first h-track is parallel to said second h-track, a shutter for covering said opening, wherein said shutter has a top proximate said second h-track, wherein said shutter is moveable between said first h-track and said second h-track because said lip is smaller than a gap that is defined between said top and said abutment when said shutter is braced by said first h-track, and a block that fills said gap and prevents said shutter from being removed, wherein said block is taller than the height of said gap less the height of said lip, and less than the height of said gap.

* * * * *